US005348156A

United States Patent [19]

Maroszek et al.

[11] Patent Number: 5,348,156

[45] Date of Patent: Sep. 20, 1994

[54] DISPLAY HOLDER

[75] Inventors: Raymond V. Maroszek, Neenah; Daniel R. Coots, Appleton, both of Wis.

[73] Assignee: Outlook Graphics Corporation, Neenah, Wis.

[21] Appl. No.: 50,936

[22] Filed: Apr. 21, 1993

[51] Int. Cl.[5] ..... B65D 5/42

[52] U.S. Cl. ..... 206/491; 206/806; 40/310; 215/100 R; 229/100

[58] Field of Search ..... 40/310, 311; 206/806, 206/491; 215/100 R; 229/100

[56] References Cited

U.S. PATENT DOCUMENTS

| | | | |
|---|---|---|---|
| 1,098,245 | 5/1914 | Gaskill . | |
| 1,536,445 | 5/1925 | Maupai . | |
| 2,037,770 | 4/1936 | Driver . | |
| 2,205,467 | 6/1940 | Cohen . | |
| 2,250,666 | 7/1941 | Godefroy | 215/303 |
| 2,340,719 | 2/1944 | Walter | 40/310 |
| 3,029,934 | 4/1962 | Hennessey | 206/216 |
| 3,089,633 | 5/1963 | Renshaw . | |
| 3,346,164 | 10/1967 | Zeitter . | |
| 3,887,069 | 6/1975 | Diwo | 206/229 |
| 4,119,203 | 10/1978 | Kuchenbecker | 206/461 |
| 4,133,429 | 1/1979 | Kuchenbecker | 206/465 |
| 4,180,165 | 12/1979 | Kuchenbecker | 206/461 |
| 4,270,659 | 6/1981 | Kuchenbecker | 206/538 |
| 4,309,835 | 1/1982 | Naeve | 40/310 |
| 4,378,831 | 4/1983 | Koltz | 40/310 |
| 4,635,291 | 1/1987 | Barton | 383/24 |

FOREIGN PATENT DOCUMENTS

| | | | |
|---|---|---|---|
| 2050213 | 7/1992 | Canada | 40/310 |

OTHER PUBLICATIONS

A xerox picture of a paper auxiliary container, admitted prior art. No date.

A xerox picture of a plastic open clam shell type auxiliary container, admitted prior art. No date.

A photocopy of a cardboard auxiliary holder, admitted prior art. No date.

*Primary Examiner*—William I. Price

*Attorney, Agent, or Firm*—Quarles & Brady

[57] ABSTRACT

Display holders and blank sheets for forming them are disclosed. When assembled, the holders have one or more boxes supported by a header piece. A brace member forms both an end flap for one or more of the boxes and provides a rigid brace to support the box(es).

4 Claims, 4 Drawing Sheets

10
13
19
14
16
15
17
39
46
18
40
53
48
21
44
51
20
47
42
54b
28b
26
28a
54a
30
27
25
29
31
54d
35
54c
28d
37
28c
38
33
36

54d
36
33
54b
31
53
28b
54c
30
40
18
28a
29
54a
17
14
13
39
51

DISPLAY HOLDER

BACKGROUND OF THE INVENTION

1. Field of the Invention

This invention relates to a display holder useful in displaying an item in a box that is suspended from the neck of a bottle or the like. More particularly the invention provides an integral bracing system for use with such holders.

2. Description of the Art

To facilitate cross selling, marketers sometimes hang samples of other products around bottle necks. These other products are typically housed in paper boxes that are suspended from a header piece that has a hole to receive the bottle neck. Unfortunately, the weight of the product often tends to cause the box to hang from the bottle in an unattractive manner and/or leads to tearing of the header. While the use of plastic headers has been tried, they are much more expensive to produce.

There is, therefore, a need for an improved holder that can be attached to a bottle in a secure manner, be capable of supporting relatively heavy products in a secure unbended manner, and which is inexpensive to produce.

SUMMARY OF THE INVENTION

The invention provides a secure means of attaching an auxiliary box holding a secondary product to a bottle holding a primary product.

In one aspect the invention provides a blank sheet of foldable material for use in forming a box having a header piece. The blank sheet has a header panel having lateral sides, upper and lower sides, an aperture through the panel, and a lower portion that can form a wall of the box; a brace panel integrally attached to the header panel by a fold line at a lateral side of the header panel, the brace panel also being connected to an integral end flap along a fold line; a generally rectangular carton panel attached to the header panel at a fold line along the lower side of the header panel, the carton panel having at least two internal fold lines that are both generally parallel to a fold line at a junction of the header panel and the carton panel, so as to define three other wall panels of the box that can be formed from the carton panel; and a tab panel connected to the blank sheet by a fold line to facilitate attachment of an end of the carton panel opposite said junction to the header panel when the box is formed, The panels of the blank sheet are juxtaposed such that when the box is assembled by folding the sheet along fold lines and the end flap is positioned inside the box, a portion of the brace panel also forms a cover for a lateral end of the box.

When this blank is folded, a display holder is created that has a header panel having lateral sides, upper and lower sides, and an aperture through the panel; a brace panel integrally attached to the header panel by a fold line at a lateral side of the header panel, the brace panel also being connected to an integral end flap at a fold line; and a generally rectangular box depending from said header panel. When the end flap is positioned inside the box by folding the brace panel and flap along fold lines, a portion of the brace panel forms a cover for an end of the box.

In another aspect, the invention provides a blank sheet of foldable material for use in forming a support wall that carries two boxes. The blank sheet has a header panel having lateral sides, upper and lower sides, an aperture through the panel, and a lower portion that can form a wall of a first box and an upper portion that can from a wall of a second box; a brace panel integrally attached to the header panel by a fold line at a lateral side of the header panel, the brace panel being connected to two integral end flaps at fold lines, the end flaps being positioned above and below the aperture and a first generally rectangular carton panel attached to the header panel at a fold line, the carton panel having at least two internal fold lines that are both generally parallel to a fold line at a junction of the header panel with the first carton panel so as to thereby define three other wall panels of the first box that can be formed from the carton panel.

The sheet also has a connector panel attached to the first carton panel by a fold line, the connector panel having an aperture that can be aligned with the aperture of the header panel; a second carton panel attached at a fold line to the connector panel, the second carton panel having at least two internal fold lines that are both generally parallel to the internal fold lines of the first carton panel so as to thereby define three other walls of the second box that can be formed from the carton panel; and a tab panel connected to the blank sheet for facilitating attachment of the second connector panel to the header panel. The panels are juxtaposed such that when the boxes are assembled and the brace panel end flaps are folded along fold lines to position flaps inside an end of each box, the brace panel forms a cover for these ends of each box and assists in retaining the two boxes in a fixed position with respect to each other.

When folded, this second blank will create the display holder that has a header wall having a substantially centrally located aperture therethrough; two generally rectangular boxes mounted against the underside of the header wall on opposite sides of the aperture so as to define a groove there between; and at least one brace panel being integrally attached to the header at a fold line at a lateral side of the header wall, the brace panel being also connected to two integral end flaps along two fold lines. The parts of the holder being juxtaposed such that end flaps can be positioned inside an end of each box by folding the brace panel and flaps along fold lines, and in this position the brace panel forms a cover for the ends of the boxes, the brace panel maintaining the boxes in a fixed position with respect to each other.

It will be appreciated that the invention provides improvements in auxiliary product boxes. A main improvement is that the box(es) are provided with end panels that double as brace members, the blank can therefore be preferably formed from paper.

In another aspect, the invention provides an auxiliary box which is totally enclosed yet still securely supported using only a single sheet of paper. The enclosed box outer surfaces provide many surfaces for placing printed advertisements.

With respect to the second embodiment, the invention also provides two compartments capable of securely and separably housing two products.

It is therefore an object of the invention to provide an auxiliary box that is readily attachable to a bottle or the like to house a secondary product.

It is another object of the invention to do so in a manner that limits bending of the display holder and box.

It is a further object of this invention to provide an auxiliary box which is sturdy and compact and reduces the risk of container collisions.

It is another object of the invention to provide an auxiliary box which may be formed from a single blank of paper board having printed indicia on only one surface thereof.

It is another object of this invention to provide a holder capable of securely and separately housing secondary products.

A further object of the invention is to provide a holder of the type set forth above which is durable, reliable, well braced, and easy to manufacture.

The foregoing and other objects and advantages of the invention will appear from the following description. In the description, reference is made to the accompanying drawings which form a part hereof, and in which there is shown by way of illustration preferred embodiments of the invention. Such embodiments do not represent the full scope of the invention, however. Reference should therefore be made to the claims for interpreting the full scope of the invention.

DESCRIPTION OF THE PREFERRED EMBODIMENT

Figure 1:
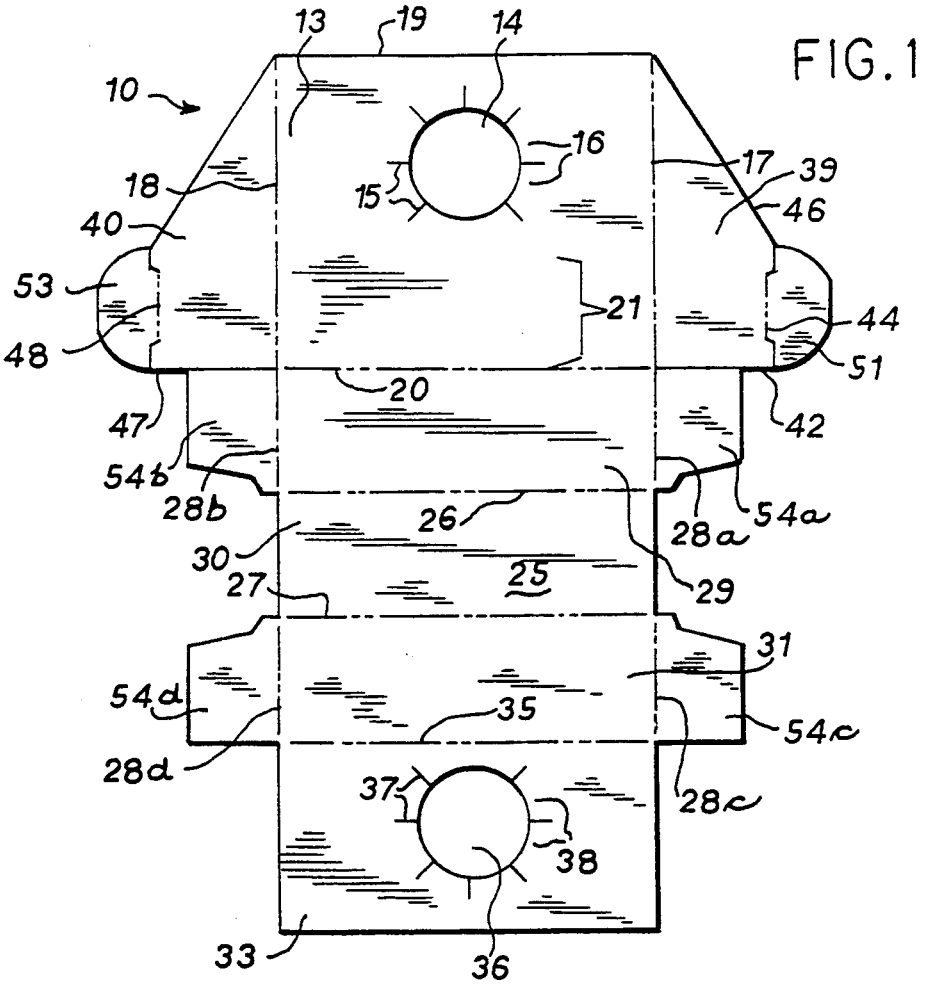
FIG. 1 is a view of a preferred embodiment of a paper blank that can be used to form a holder in accordance with the present invention.

Referring now to FIG. 1, a blank (generally 10) is of thin gauge paper board. When fully set up, it forms the holder (generally 11) shown in FIG. 4.

Blank 10 is provided with a plurality of fold lines and cuts which are adapted to cooperate with one another so as to form a header panel 13. The header panel 13 is generally rectangular and has an upper edge 19, a first lateral side defined by fold line 17, a second lateral side defined by fold line 18 and a lower side defined by fold line 20. A lower portion 21 of the header panel 13, located between the aperture 14 and fold line 20 forms one wall of the box 22 (seen in FIG. 4).

An enlarged laterally central aperture 14 is provided in the blank 10. The aperture 14 is sized so as to tightly fit around the neck of a bottle (see FIG. 4). The aperture 14 is provided with a series of circumferentially spaced radial slits 15. The slits 15 provide tongues 16 for engaging the bottle.

A square box panel 25 is connected to the header panel 13 along fold line 20. Panel 25 has two fold lines 26, 27 equally dividing the area of the box panel 25 into a bottom panel 29, front panel 30 and top panel 31. Fold lines 26, 27 are substantially parallel to fold line 20.

A tab panel 33 is connected to the lower end of the box panel 25 along fold line 35. The tab panel 33 is constructed with a centrally located aperture 36 substantially similar to the header panel aperture 14. The tab panel aperture 36, like the header panel aperture 14, has circumferentially spaced radial slits 37 that define tongues 38. When the box is formed, the shown surface of tab panel 33 is in full contact with the shown surface of header panel 13, so that the tab panel aperture 36 aligns with the header panel aperture 14.

In keeping with one of the primary objects of the invention, a first brace closure panel 39 is connected to a lateral side of header panel 13 along fold line 17. A second brace closure panel 40 is connected to the opposite lateral side of header panel 13 along fold line 18. The first brace closure panel 39 has a first edge defined by fold line 17, a second edge 42 adjacent the first edge at a 90° angle, the second edge 42 being collinear with fold line 20 when the blank 1 is flat, a third edge defined by fold line 44, fold line 44 being parallel to fold line 17, and a fourth edge 46.

The second brace closure panel 40 is similar in construction to panel 39. Edge 47 is adjacent line 18 at a 90° angle and is collinear with fold line 20 when the blank is flat. Another edge is defined by fold line 48 and is parallel to fold line 18. There is also edge 49. Arcuate end flaps 51, 53 are provided on each brace closure panel 39, 40 along the brace closure panels respective distal fold lines 44, 48.

In an especially preferred form, four protection closure flaps are provided on the lateral edges of the box panel 25. Two protector flaps **54*a*, 54*b* are connected to the front panel 29, one on each lateral edge defined by fold lines 28A and 28*b*. Two more protector flaps 54*c*, 54*d* are connected to opposite lateral edges of panel 31 one on each lateral edge defined by fold lines 28*c* and 28*d***.

Figure 2:
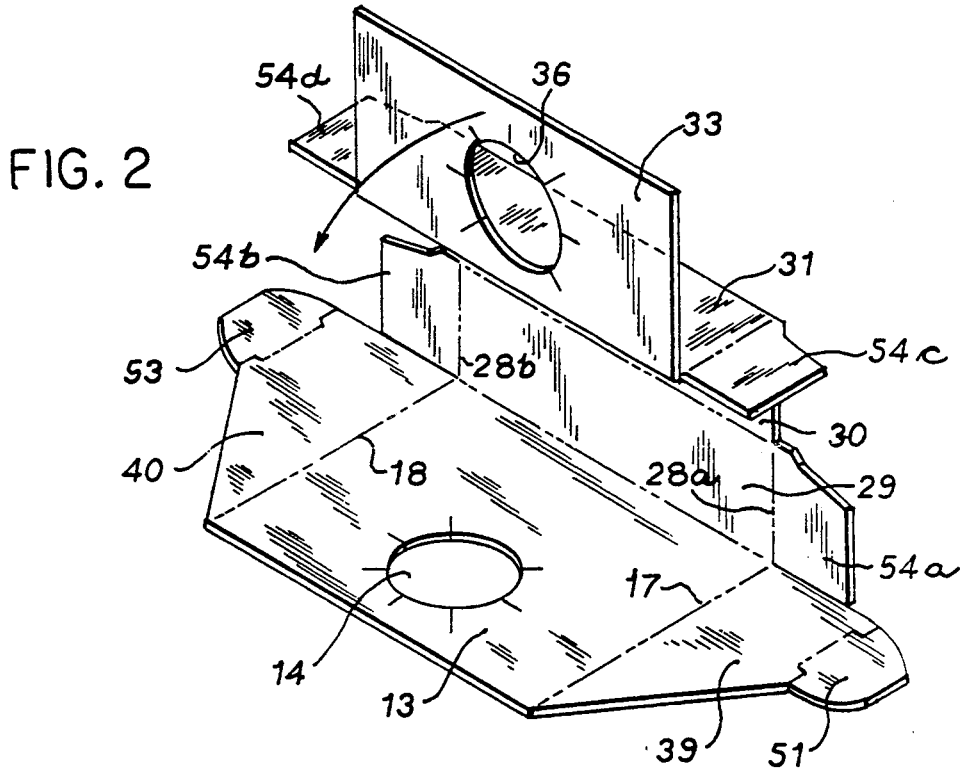
FIG. 2 is a perspective view of the blank of FIG. 1, partially folded.
Figure 3:
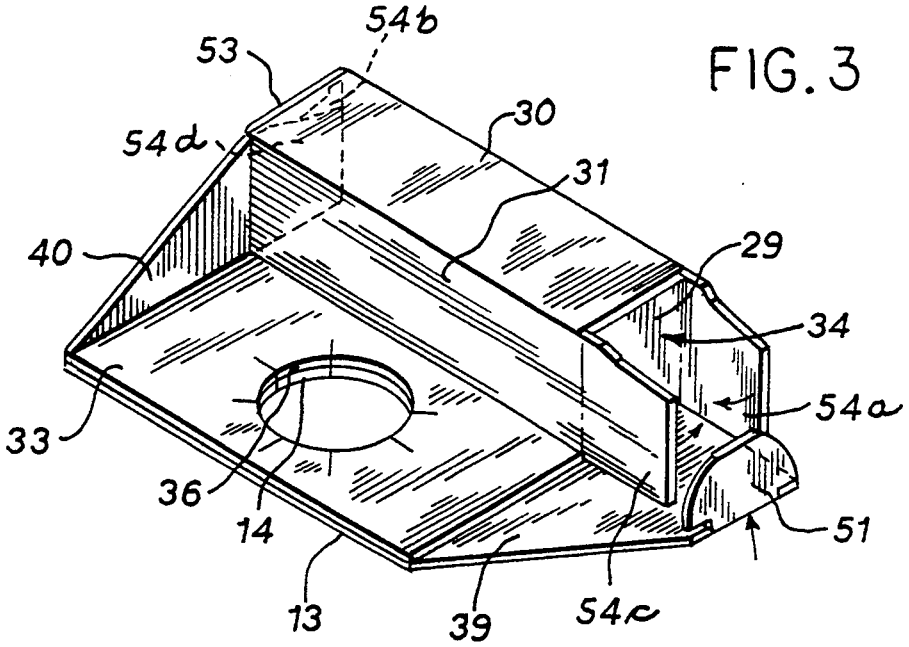
FIG. 3 is a perspective view of the blank of FIG. 1, almost completely folded.
Figure 4:
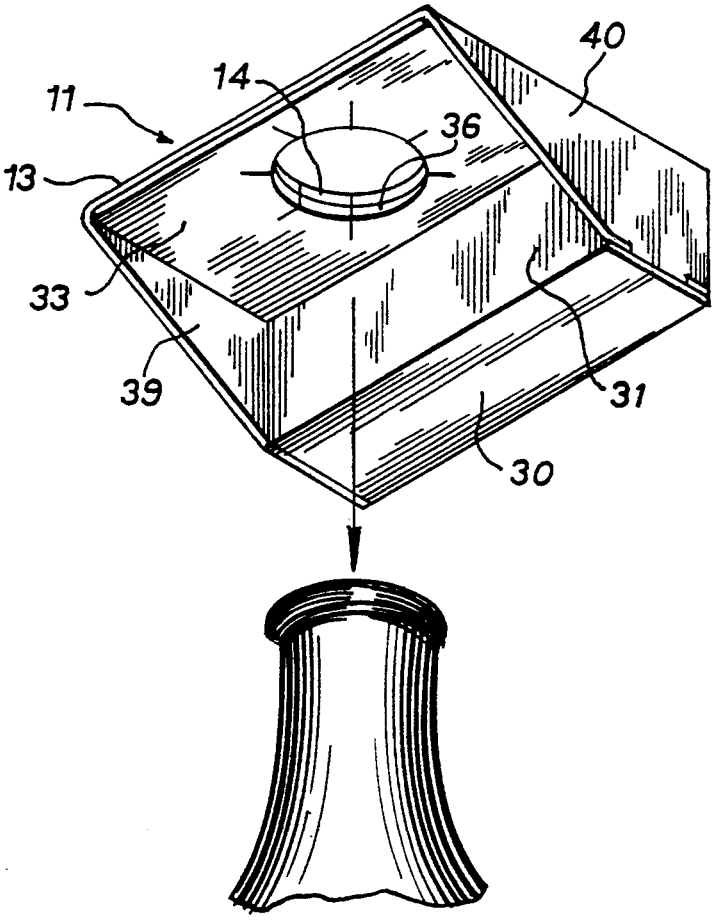
FIG. 4 is a perspective view of a holder formed from the blank of FIG. 1, about to be installed on a bottle.

Turning now to FIGS. 2–4, in folding the box, panel 29 is folded into an upright position with respect to header panel 13. Panel 31 is then folded relative to bottom panel 30 so as to assume a position parallel to header panel 13. Tab panel 33 is then folded back so as to be perpendicular to back panel 31. As best seen in FIG. 3, panel 30 is then folded relative to panel 29 so as to assume a position wherein panel 30 is parallel to header panel 13 and a surface of tab panel 33 is in full contact with a surface of header panel 13. After this fold, the tab panel aperture 36 is in complete registration with the header panel aperture 14 and a box chamber 34 is defined by header panel 13, panel 29, panel 30 and panel 31.

Referring still to FIG. 3, flap **54*a* can be folded inward relative to front panel 29 so as to partially close the end of the box chamber 34. In a like fashion, flap 54*c* can be folded so as to close the end of the box chamber 34. Next, end flap 51 can be folded to an upright position with respect to brace closure panel 39 and brace closure panel 39 can be folded into a position so that end flap 51 is frictionally received inside the box chamber 34**.

In a like manner, protection flaps **54*b* and 54*d* cooperate with brace closure panel 40 and end flap 53 to close the other end of box chamber 34. It will be appreciated that a promotional item can be inserted in the box before closure, and suitable advertisements for the item can be printed on the opposite side of the blank form that is shown in FIG. 4. The completely formed box 11 about to be installed on a bottle is shown in FIG. 4**.

Figure 5:
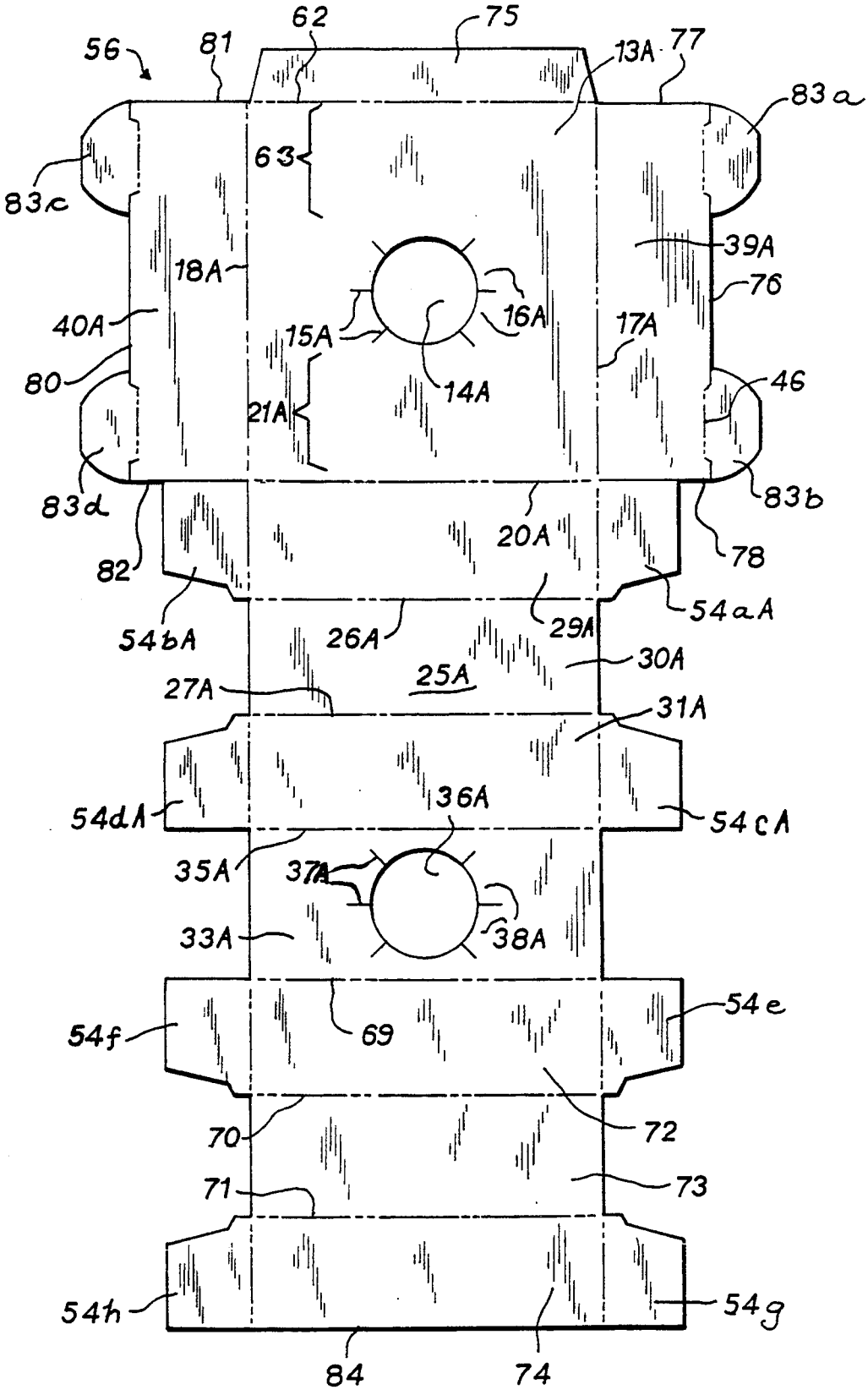
FIG. 5 is a view similar to FIG. 1, but showing a blank suitable to create a second preferred embodiment.
Figure 7:
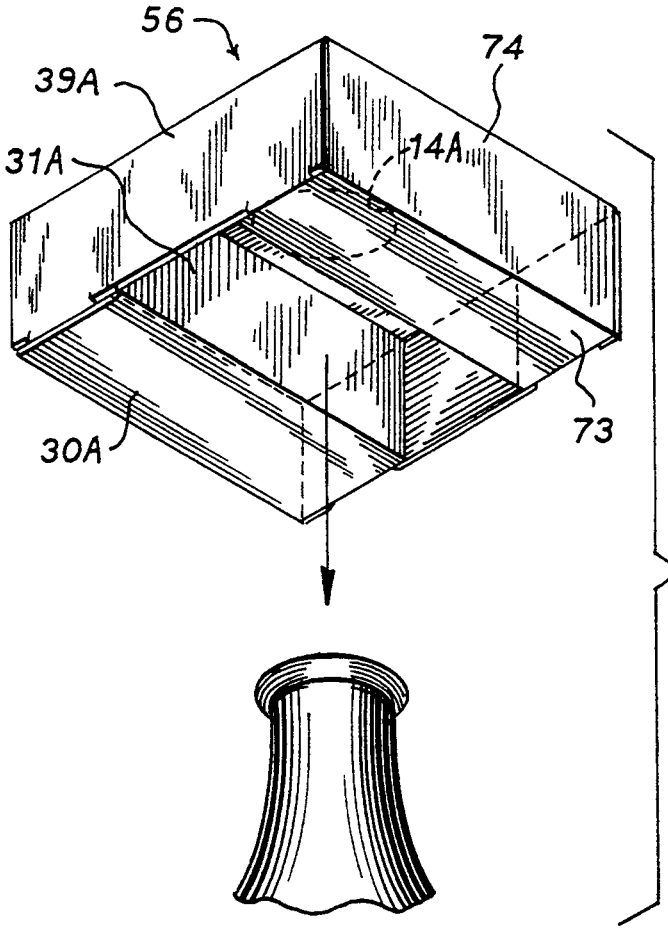
FIG. 7 is similar to FIG. 4, but showing the second preferred embodiment of the holder.

Referring now to FIG. 5, there is shown a blank 56 of thin gauge paper board which is adapted, when fully set up, to form the second embodiment of this invention. A dual compartment holder 57 formed from the FIG. 5 blank is shown in FIG. 7. For convenience in studying the present disclosure, those parts of the second embodiment which are analogous to the first embodiment are identified by the same reference numerals which identify the corresponding parts of the first embodiment, albeit with an A listed thereafter.

Blank 56 has a header panel 13A which is provided with an enlarged centrally located aperture 14A. The header panel 13A is generally of a square shape and has an upper edge defined by fold line 62, a first lateral side defined by fold line 17A, a second lateral side defined by fold line 18A and a lower side defined by fold line 20A. A lower portion 21A of the header panel 13A, disposed between the aperture 14A and fold line 20A, is used to form one wall of a first box 22 as shown in FIG. 7. An upper portion 63 of header panel 13A, disposed between the aperture and fold line 62, is used in a like manner to form one wall of a second box 66 as shown in FIG. 7. The aperture 14A should be sized so as to tightly fit around the neck of a bottle (see FIG. 7). In the preferred embodiment, aperture 14A is provided with a series of circumferentially spaced radial slits 15A. The slits 15A provide tongue 16 for engaging the neck of the bottle.

A square first box panel 25A is connected to header panel 13A along fold line 20A. The first box panel 25A has two fold lines 26A, 27A equally dividing the area of the first box panel 25A into panels 29A, 30A and 31A, the fold lines 26A, 27A being substantially parallel to fold line 20A.

A connector panel 33A is connected at the lower end of the first box panel 25A along fold line 35A. The connector panel 33A is constructed with a centrally located aperture 36A substantially similar to aperture 14A of the header panel 13A. The tab panel aperture 36A, has circumferentially spaced radial slits 37A that define tongues 38A.

A second square box panel 68 is provided connected to connector panel 33A along fold line 69 from which the three remaining second box 66 walls are constructed. The second box panel 68 has two fold lines 70, 71 equally dividing the area of the second box panel 68 into panels 72, 73 and 74. The fold lines 70, 71 are substantially parallel to fold line 69.

In keeping with one of the primary objects of the invention, a first brace closure panel 39A is connected to one lateral side of header panel 13A along fold line 17A, and a second brace closure panel 40A is connected to the opposite lateral side of header panel 13A along fold line 18A on blank 56. Both brace closure panels 39A, 40A have a rectangular shape. The first brace closure panel 39A has a long edge defined by fold line 17A, a second long edge 76 parallel to the first, a first short edge 77 collinear with fold line 62 and a second short edge 78 collinear with fold line 20A (when the blank 56 is flat as in FIG. 5).

The second brace closure panel 40A has a first long edge defined by fold line 18A, a second long edge 80 parallel to the first, a first short edge 81 collinear with fold line 62 and a second short edge 82 collinear with fold line 20A when the blank 56 is flat as in FIG. 5. Four arcuate end flaps 83*a–d*, are provided on the blank, two each on the second long edge 76, 80 of each brace closure panel as shown in FIG. 5.

Eight protector flaps 54*a*A–*h* are preferably provided on the lateral edges of the first 25A and second 68 box panels. Two protector flaps 54*a*A, 54*b*A are connected to the first front panel 29, one on each lateral edge defined by fold lines. Two protector flaps 54*c*A, 54*d*A are connected to the panel 31A, one on each lateral edge defined by fold lines. Two more protector flaps 54*e*, 54*f* are connected to the panel 72, one on each lateral edge defined by fold lines 28*e*, 28*f*. Two more protector flaps 54*g*, 54*h*, for a total of eight protector flaps, are connected to the panel 74, one on each lateral edge defined by fold lines. A tab 75 is preferably connected at the top edge of the header panel 13 along tab fold line 62.

Figure 6:
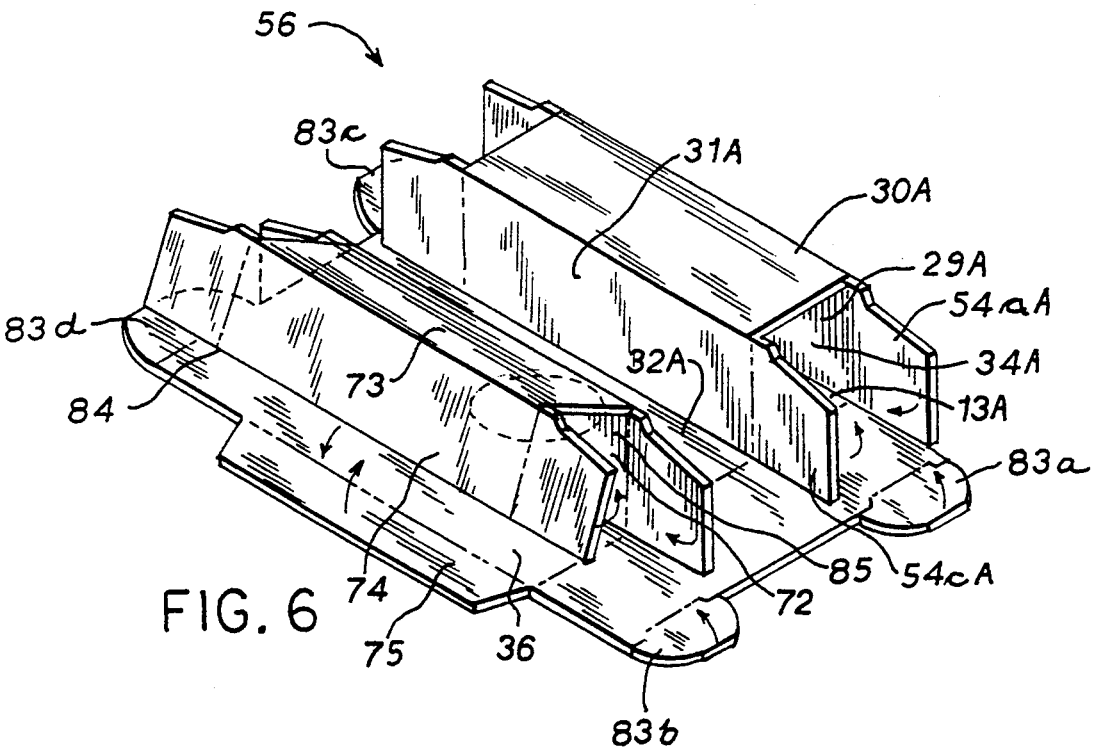
FIG. 6 is a perspective view of the blank of FIG. 5, shown during one stage of folding.

Turning now to FIGS. 6 and 7, in setting up the blank 56, panel 29A is folded into an upright position with respect to header panel 13A. Panel 31 is then folded relative to panel 30A so as to assume a position parallel to the header panel 13A. Connector panel 33 is then folded back so as to be perpendicular to panel 31A. Then panel 30A is folded relative to panel 29A so as to assume a position wherein panel 30A is parallel to header panel 13A and a surface of connector panel 33A is in full contact with a surface of header panel 13A. After this fold, the aperture 36A is in complete registration with aperture 14, and a first box chamber 34A is defined by header panel 13A, and panels 29, 30 and 31.

Next, panel 72 is folded into an upright position with respect to panel 33A. Panel 73 is then folded into a horizontal position, parallel to portion 63 of header panel 13A, tab 75 is folded into a vertical position perpendicular to header panel 13A. Then, front panel 74 is folded into a vertical position relative to bottom panel 73, so that the bottom edge 84 of panel 74 makes contact with the tab 75. A suitable adhesive can glue the tab 75 against an inside wall of panel 74. By this, a second box chamber 85 is defined by the upper portion 63 of header panel 13, the panel 74, the panel 73 and the panel 72.

Protector flap 54*a*A can then be folded inward relative to front panel 29A so as to partially close one end of box chamber 34A. In a like fashion, protector flap 54*c*A can be folded so as to close the same end of first box chamber 34A. Now, the other protector flaps can also be folded in a like fashion. Next, end flaps 83*a–d* are folded to an upright position with respect to brace closure panels 39A and 40. Brace closure panel 39A is then folded into a vertical position so that end flaps 83*a*, 83*b* are frictionally received inside their respective box chambers 34A, 85. In a similar manner, end flaps 83*c*, 83*d* are folded to close the other ends of first box chamber 34A and second box chamber 85. The completely formed box of the second preferred embodiment is shown in FIG. 7.

Prior to the blank assuming the condition of FIG. 7, the products to be packaged may be located within the box chambers 34A, 85. The embodiment of FIG. 7 has all the exposed surfaces thereof formed by a single side of blank 56. Thus, the blank need have only one printed surface. Furthermore, the various panels, flaps, tabs and portions cooperate with one another to form a very strong and sturdy box, not withstanding the calliper of the material used.

The above description has been that of a preferred embodiment of the present invention. It will occur to those who practice the art that many modifications may be made with out departing from the spirit and scope of the invention. For example, various modifications besides those shown and discussed may be made with regard to the shape and size of the various panels and with regard to the apertures in the header 13 and tab 33 panels. For example, in the second embodiment, the various panels that form box chambers 34A, 85 could be of different sizes so that two different size chambers 34A, 85 result. Also, the direction up and down with respect to the blank are arbitrary and are only intended to provide relative direction between parts of the blank.

Moreover, when double header panels are used and are glued together this gives even greater strength to the hanger. Note also that the end panels can be glued in place instead of being locked in place if desired.

We claim:

1. A blank sheet of foldable material for use in forming a box having a header piece, the blank sheet comprising:

a header panel having lateral sides, upper and lower sides, an upper portion extendable at least partially above a top wall of the box when the box is formed, an aperture through the upper portion, and a lower portion that can form a wall of the box;

a brace panel integrally attached to the header panel by a fold line at a lateral side of the header panel, an upper portion of the brace panel being attached to the upper portion of the header panel, the brace panel also being connected to an integral end flap along a fold line;

a generally rectangular carton panel attached to the header panel at a fold line along the lower side of the header panel, the carton panel having at least two internal fold lines that are both generally parallel to a fold at a junction of the header panel and the carton panel, so as to define three other wall panels of the box that can be formed from the carton panel; and a tab panel connected to the blank sheet by a fold line to facilitate attachment of an end of the carton panel opposite said junction to the header panel when the box is formed;

whereby, the panels of the blank sheet are juxtaposed such that when the box is assembled by folding the sheet along fold lines and the end flap is positioned inside the box, a lower portion of the brace panel also forms a cover for a lateral end of the box.

2. The blank sheet of claim 1, wherein the tab panel is linked along a fold line to the carton panel and has an aperture that can be aligned with the header aperture when the box is formed.

3. The blank sheet of claim 1, wherein there is also a second brace panel attached to the header panel along a fold line that is at an opposite lateral side of the header from the first brace panel.

4. A display holder, comprising:

a header panel having lateral sides, upper and lower sides, an upper portion and a lower portion, and an aperture through the upper portion;

a brace panel integrally attached to the header panel by a fold line at a lateral side of the header panel, an upper portion of the brace panel attached to the upper portion of the header panel, the brace panel also being connected to an integral end flap at a fold line; and a generally rectangular box depending from said header panel, the upper portion of the header panel extending at least partially above a top wall of said box;

whereby, when the end flap is positioned inside the box by folding the brace panel and flap along fold lines, a lower portion of the brace panel forms a cover of an end of the box.

* * * * *